United States Patent [19]

Eckold et al.

[11] Patent Number: 4,972,565

[45] Date of Patent: Nov. 27, 1990

[54] TOOL SET FOR CONNECTING SHEET METAL PIECES

[76] Inventors: Gerd-Jurgen Eckold, Silberhutte 11,, D-3424 St. Andreasberg; Hans Maass, Germelmannstr. 12, D-3422 Bad Lauterberg, both of Fed. Rep. of Germany

[21] Appl. No.: 425,670

[22] Filed: Oct. 23, 1989

[30] Foreign Application Priority Data

Oct. 29, 1988 [DE] Fed. Rep. of Germany ..... 3836937

[51] Int. Cl.[5] ..... B23P 19/04

[52] U.S. Cl. ..... 29/243.529

[58] Field of Search ..... 29/798, 509, 432, 522 A, 29/243.5, 243.52, 243.53, 21.1; 72/465, 466, 470, 471, 478, 395

[56] References Cited

U.S. PATENT DOCUMENTS

| | | | |
|---|---|---|---|
| 3,763,687 | 10/1973 | Numoto et al. | 72/395 |
| 4,344,794 | 7/1983 | Shirey | 29/243.5 |
| 4,459,735 | 7/1984 | Sawdon . | |
| 4,584,753 | 4/1986 | Eckold et al. . | |
| 4,614,017 | 9/1986 | Eckold et al. . | |
| 4,658,502 | 4/1987 | Eckold et al. . | |
| 4,726,000 | 4/1973 | Hafner . | |
| 4,757,609 | 7/1988 | Sawdon | 72/965 |
| 4,760,634 | 8/1988 | Rapp . | |
| 4,803,767 | 2/1989 | Obrecht et al. . | |
| 4,831,704 | 5/1989 | Rapp | 29/243.53 |

FOREIGN PATENT DOCUMENTS

| | | | |
|---|---|---|---|
| 1602494 | 12/1970 | Fed. Rep. of Germany | 72/465 |

OTHER PUBLICATIONS

Soviet Inventions Illustrated, 09/02/87, DerWent Publications.

*Primary Examiner*—Robert C. Watson

*Attorney, Agent, or Firm*—Townsend and Townsend

[57] ABSTRACT

The tool set comprises a male die and a female die cooperating to connect metal sheet workpieces when driven by a press. The male die is trunconical. The female die includes an anvil and forming members which, in a first operation phase, are stationarily supported and, in a second phase, are subjected to a movement in the same direction as the male die, thereby simulating the effect of a double stroke press.

9 Claims, 5 Drawing Sheets

Fig. 9
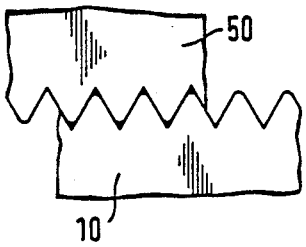
Fig. 8
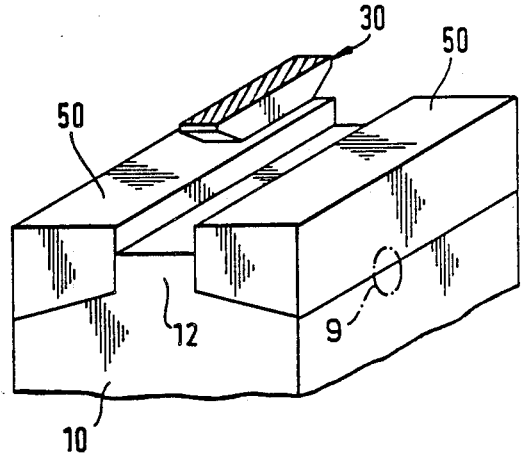
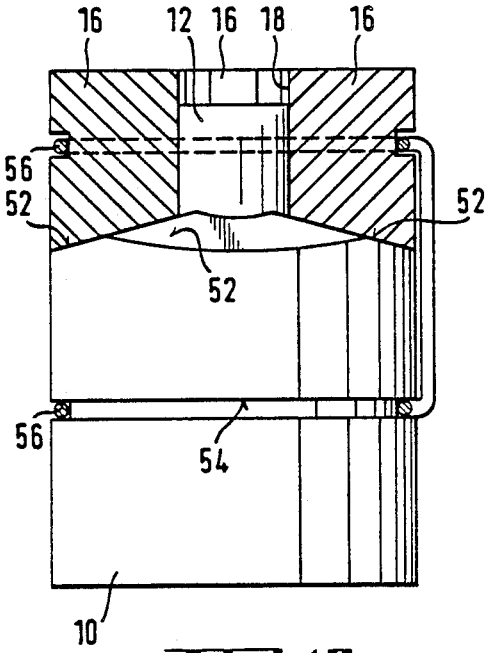
Fig. 10
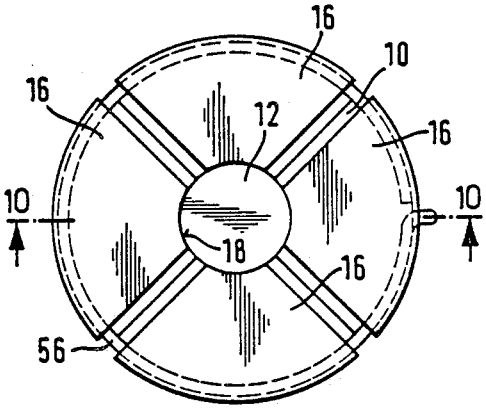
Fig. 11

TOOL SET FOR CONNECTING SHEET METAL PIECES

BACKGROUND OF THE INVENTION

1. Field of the Invention

The present invention relates to an apparatus for joining or connecting sheet metal pieces, and in particular, to a tool set to be mounted in a press.

2. Description of the Background Art

U.S. Pat. Nos. 4,614,017, 4,658,502, 4,584,753, and pending U.S. patent application Ser. Nos. 07/314,007 and 07/324,825 disclose devices of the general nature to which the tool set of the present invention belongs, and the disclosures thereof are incorporated herein by reference. Briefly, a male die is mounted in a press ram and a female die is mounted in a press frame. The female die defines a cavity into which a section of sheets disposed between the dies is deformed by the male die. In a first phase of deformation, the male die performs an embossing operation between forming members of the female die and, in a second phase, subjects the embossed material to pressure between the male die and an anvil of the female die so that the embossed material flows laterally to result in a rivet like connection or joint as the forming members, during the second phase, yield laterally. Only one single press stroke is necessary to complete the connection.

The female die need not have laterally yielding forming members if a double stroke press is used, as disclosed in U.S. Pat. No. 3,726,000. The forming members of the female die remain stationary but its anvil is displaced against the male die so as to perform the cold flux deformation. It is generally assumed that connections so made may be more rigid than those of the firstly described process.

It is an object of the present invention to provide a tool set which allows the formation of very rigid connections of the secondly mentioned type but which does not need a double stroke press.

SUMMARY OF THE INVENTION

The tool set of the present invention comprises a male die and a female die mounted in a press, which dies are able to join two or more sheet metal pieces disposed therebetween upon press actuation. The female die includes an anvil and at least one forming member which, together with the anvil, defines a cavity into which the male die embosses material of the metal sheets. During a first phase of the operation, the forming member is rigidly supported on the anvil or a common socket. In a second phase of operation, the forming member or members are not supported any more by the anvil or socket but are instead displaced in a direction which has a component parallel to the movement direction of the male die. In other words, the movement of the anvil against the male die, as provided in the prior art, with stationary forming members is replaced with an inverted system, and as the anvil now remains stationary, there is no need to provide a double stroke press.

BRIEF DESCRIPTION OF THE DRAWINGS

Preferred embodiments of the invention are illustrated in the accompanying drawings and will be described in detail hereunder.

FIG. 8 is a partially broken away isometric view of a further tool set according to the invention.

FIG. 9 shows a detail of FIG. 8, seen in direction "9" of FIG. 8.

FIG. 10 is a longitudinal section view of a still further female die.

FIG. 11 is a plan view of the female die of FIG. 10.

DESCRIPTION OF THE SPECIFIC EMBODIMENTS

Figure 1:
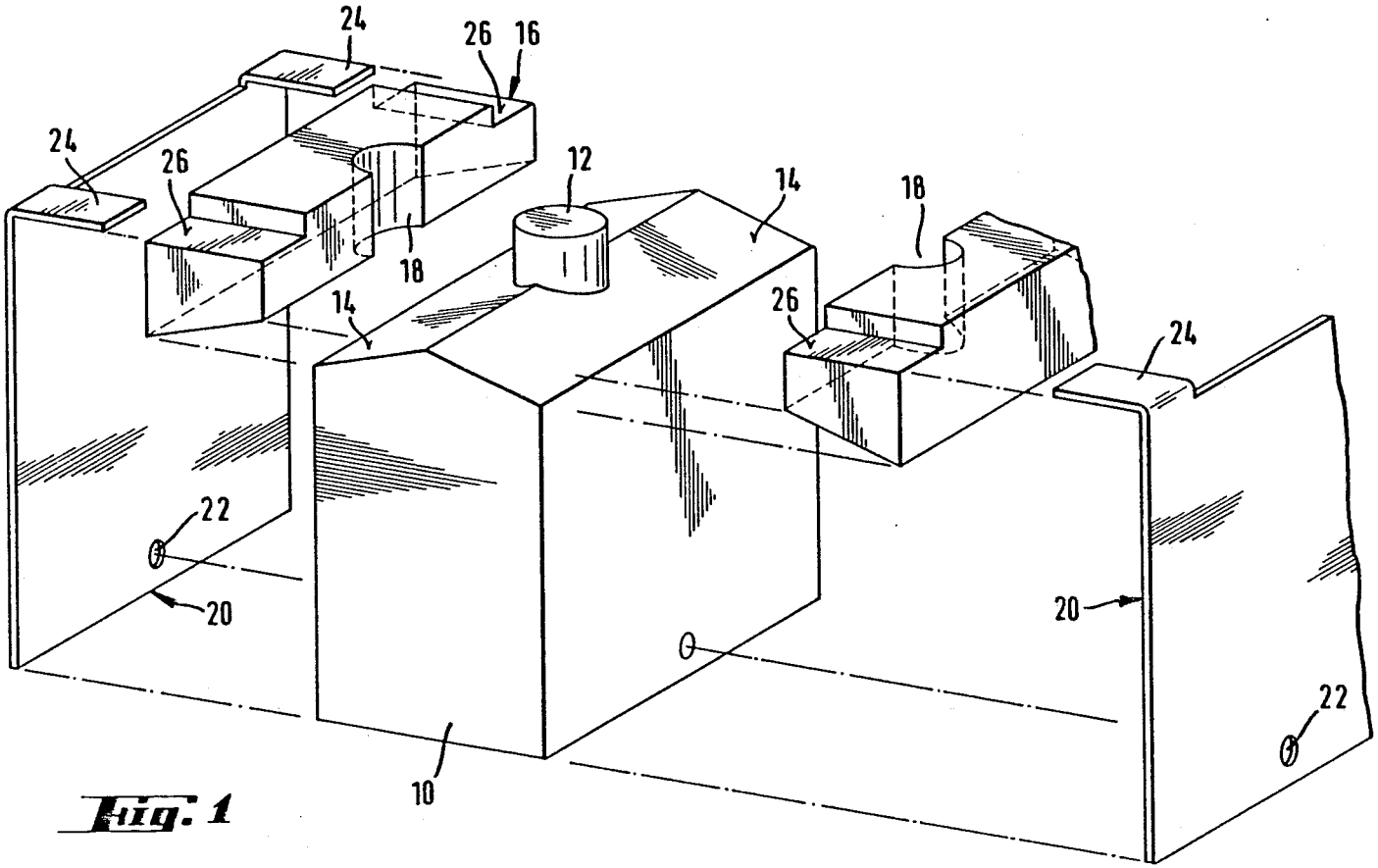
FIG. 1 is an isometric view of the female die design.
Figure 2:
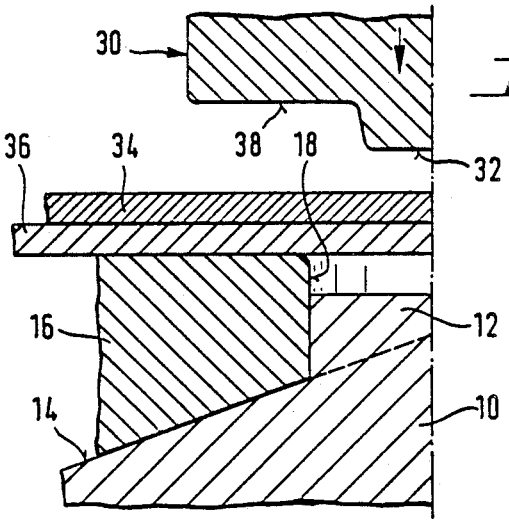
FIGS. 2, 3, and 4 illustrate in half longitudinal section, three phases of a connecting operation.
Figure 3:
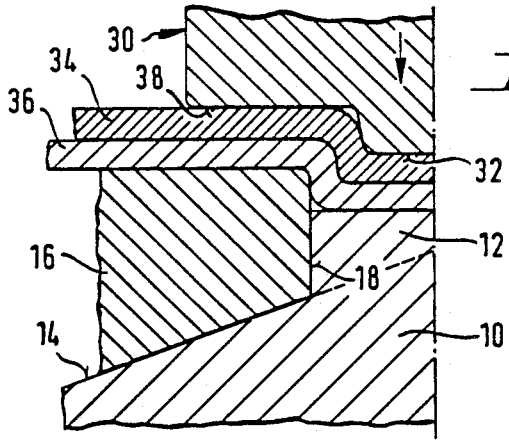
Figure 4:
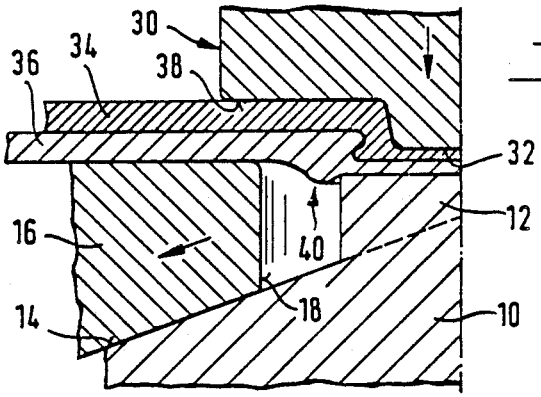

Of the tool set in its first embodiment, FIG. 1 illustrates the female die only while the respective male die is illustrated in FIGS. 2, 3, and 4.

The female die of FIG. 1 comprises a socket 10 supporting an anvil 12 which may be inserted into the socket or manufactured integrally with the socket. The free end face of the anvil 12 is circular. Further, the top side of socket 10 is provided with outward and downward sloping skew surfaces 14. These surfaces 14 support forming members 16 which are formed identically as mirror images of each other. For this reason, only one of the forming members 16 is completely illustrated. Each forming member 16 comprises a half-cylindrical recess 18, and the recesses of the two forming members surround the anvil 12 in abutting relation when the female die is in its rest position. For each forming member 16, a lamella 20 made of elastic steel is mounted as at 22 on the socket 10. Each lamella 20 comprises retaining arms 24 which engage over the respective forming member 16 which, for this purpose, has respective step-shaped indentations 26 on either side or recess 18. In this manner, the two forming members are displaceably connected to socket 10 and anvil 12.

Male die 30 includes a truncated cone 32 having a circular front face 32. The operative diameter of the front face of cone 32, however, is significantly smaller than that of the cavity formed by the anvil 12 and the forming member recesses 18, with the result that upon cooperation of male and female dies, sheets 34 and 36 which are to be connected are not cut through but embossed only. An expert skilled in the art will understand that the principles of the present invention may be applied also with through-cutting dies as disclosed in the patents cited above.

FIGS. 2, 3, and 4 illustrate the operation of the tool set. The sheets 34 and 36 to be joined rest on the forming members 16 of the female die which is mounted in a press frame (not shown). The male die 30 is mounted in a press ram (not shown) in concentric relation with respect to the anvil 12 of the female die. FIG. 2 illustrates the conditions prior to press actuation.

FIG. 3 illustrates the condition after the first or embossing phase. Male die 30 has deformed material of both sheets 34 and 36 into the cavity defined by forming member recesses 18 and the top face of anvil 12. The embossing step is completed once a stop member such as shoulder 38 which surrounds the cone portion 32 of male die 30 meets the uppermost sheet 34. The dimensions are selected such that deformation of the embossed material starts in directions parallel to the sheet 34 and 36 faces.

The slope or skew angle of surfaces 14 is selected such that the frictional engagement between these surfaces and the forming members 16 supported by them in combination with the bias produced by lamellae 20 is sufficient to prevent yielding of the forming members upon the embossing step. In fact, it has been found that during the embossing step, laterally directed forces are surprisingly small. However, as soon as laterally acting forces due to the laterally flowing material become effective, the forming members 16 yield or give way laterally and, because of the sloping skew surfaces 14, also yield in a direction parallel to the male die 30 movement because the sliding friction is now insufficient to retain the forming members.

FIG. 4 illustrates the final phase of the deformation process. The material of both sheets 34 and 36 has undergone a thickness reduction to about one third of the original thickness, and the displaced material has flown laterally over the edge of the anvil face thereby forming a projecting bead 40, as a result of the material of sheet 34 having flowed into this bead thereby forming an inter-engaging connection.

Figure 5:
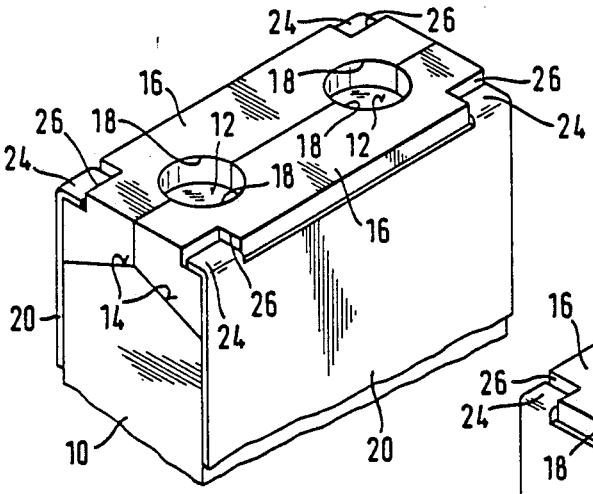
FIGS. 5 and 6 are isometric views of modified female dies.

The joint produced with the tool set of FIGS. 1 through 4 has good strength when subjected to forces parallel and orthogonal to the sheets. However, the stability against torque about an axis orthogonal to the sheets may be insufficient so that two such joints may be provided side to side. FIG. 5 illustrates a female die permitting, in cooperation with a twin male die (not shown), the provision of such a double connection by means of one single press stroke. The components corresponding to those of FIG. 1 have been marked with the same reference numerals so that a further detailed description does not appear necessary.

Figure 6:
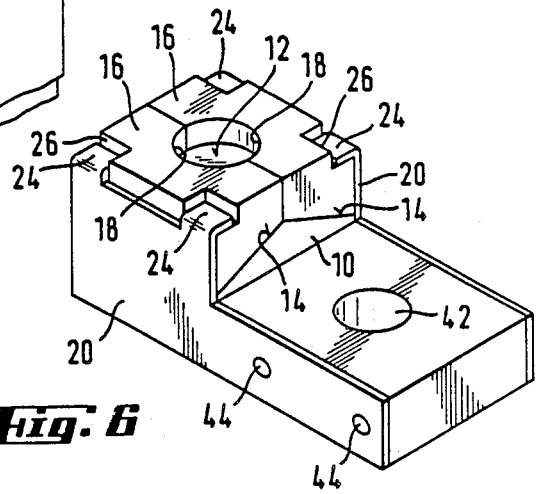

Under certain conditions, the female die of FIG. 1 or 5 may exhibit a dimension in press stroke direction which does not permit its use. In such cases, a design as illustrated in FIG. 6 may be used. The socket 10 extends laterally instead of downward where it has a mounting aperture 42, and the elastic lamellae are riveted to the socket as at 44.

Figure 7:
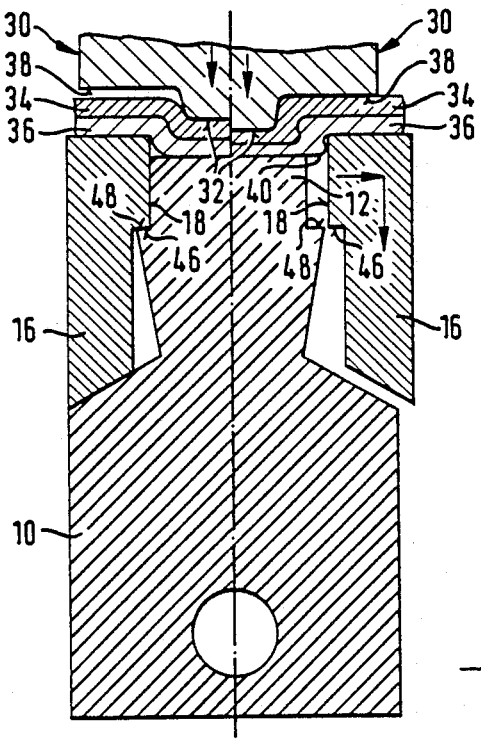
FIG. 7 is a longitudinal section view of a further female die embodiment.

The embodiments described so far are based on frictional engagement between socket and forming members. The coefficient of friction, however, depends inter alia upon the surface properties of the paired components and are, therefore, not necessarily reproducible. In the embodiment of FIG. 7, the forming members 16 present inward protruding edges 46 supported by a mating radial shoulder 48 of the anvil. While the release of the forming members 16, in the first embodiment, occurred in response to increasing force, in the embodiment of FIG. 7 the release occurs in response to displacement of the laterally flowing material which "throws off" the forming members permitting the displacement of the latter downwards. It is to be noted that the male die design and that of the lamellae may be like those of the previous embodiments so that these components have not been illustrated. Inversely, the principle of FIG. 7 may be applied to the preceding embodiments as well.

This is also true for the embodiment of FIG. 8. The forming members have a simple prismatic shape, and the male die has a correspondingly elongated shape (lamellae again not shown). This embodiment has the advantage that the press need not necessarily operate in a direction orthogonal to the anvil end face but may have an angular inclination of up to 30° in a plane parallel to edges 50 while still performing a suitable connection. This is of importance in cases where complex workpieces are to be joined by means of a single press stroke which produces simultaneously a plurality of connections using a corresponding number of tool sets.

FIG. 9 illustrates in enlarged scale relative to FIG. 8, a view in direction of arrow "9" in a modified embodiment. The skew path of the forming members and the sliding faces thereof are provided with grooves which extend parallel to the displacement direction with the result that, in addition to the frictional effect, a certain wedging contributes to retain the forming members, rendering the release better reproducible. Of course, this modification is applicable in the other embodiments too.

The female die of FIGS. 10 and 11 has four forming members 16, each supported on its own plane skew surface 52. Socket and anvil are cylindrical. The socket has a circumferential groove 54 into which a wire spring 56 is snap-fitted; an arm of this spring extends upwards and is bent to form an open ring engaging into respective outer grooves of the forming members. This ring thus acts as a retaining spring.

Figure 12:
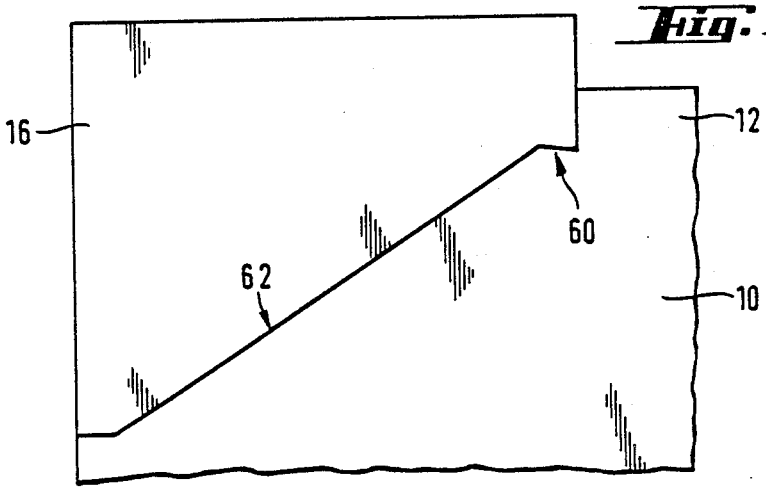
FIG. 12 illustrates in partial side view, an enlarged scale of a modification of a female die design.

FIG. 12 illustrates in enlarged scale but rather schematically a design in which the forming member 16 not only is in abutting relation with a radial support face as in FIG. 7 but positively inter-engages with the anvil as at 60. It has been found that even here, the laterally flowing material releases the forming member, the release being very well reproducible. It will be understood that a plurality of such "claws" may be provided along the guide path 62. As in FIGS. 7 and 8, the restoring and retaining spring is not shown.

Figure 13:
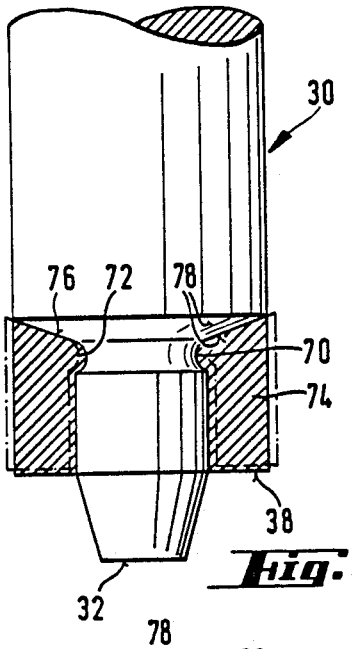
FIGS. 13 and 14 show in section and bottom view, respectively, a modified male die.
Figure 14:
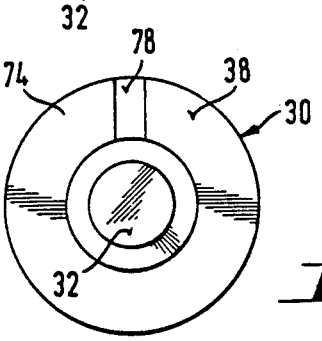

Normally, the workpieces may easily be removed from the dies after completion of a joint. A workpiece may, however, sometimes get stuck to the male die. For this reason, the male die of FIGS. 13 and 14 is provided with a throw-off member which performs a very little stroke (a large stroke is unnecessary because of the conical shape of the male die). The male die 30 has a circumferential groove 70 snap-fittingly receiving a bulge 72 of a slotted annulus. The annulus is quite rigid so that it will be spread upon engagement of the sheets to a very little extent when its inner core 76 slides along the conical portion 78 of the male die. Upon press ram return, it will spring back so as to throw off the workpiece. It will be understood that other types of throw-off means may be provided, in particular those which are independent of the shoulder 38.

Figure 15:
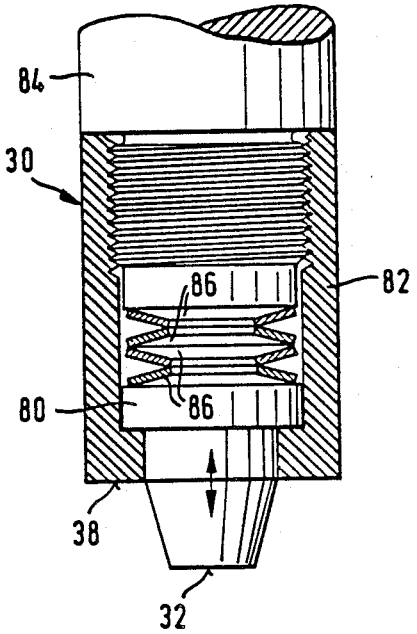
FIG. 15 is a section view of a still further male die.

It is known that during deformation, the counterforces acting upon male die 30 and anvil 12 exhibits a sharp increase from the first embossing phase to the second flow phase. This fact is utilized in the male die of FIG. 15 to withdraw the male die during material flow so that the connection becomes more flat. The male die has a radial shoulder 80 guided along a sleeve 82 which has the shoulder 38. Sleeve 82 is screw-connected to a male die carrier 84. Between the latter and shoulder 80, a dish spring set 86 is disposed. It is well known that dish springs have a negative characteristic so that once the maximum load provided by the specification of the springs is reached, the male die will suddenly yield. It will be understood that preferably, the release force for the forming members is slightly smaller than the maximum load the dish springs can stand.

It is to be noted that the principle of a slotted spring annulus illustrated in FIGS. 13 and 14 for the male die may be utilized for the female die, too. For example, the forming members of the embodiment shown in FIGS. 10 and 11 may be combined in one single slotted ring thereby obviating the separate restoring and retaining spring 56.

Although the foregoing invention has been described in detail for purposes of clarity of understanding, it will be obvious that certain modifications may be practiced within the scope of the appended claims.

What is claimed is:

1. A tool set for connecting sheet metal pieces, comprising:

a male die having a front face; and a female die including an anvil and forming members, wherein one of said dies is mountable on a stationary press frame and the other of said dies is mountable on a press ram which is reciprocable relative to said press frame such that said male die front face is opposite said anvil, wherein upon press actuation, said male die deforms sheet material disposed between said dies into a female die cavity defined by said anvil and said forming members so as to make said deformed material inter-engage, said male die including a stop member delimiting its penetration depth, and said forming members of said female die being mounted on said anvil such as to be displaced in a predetermined direction which includes a component in direction of male die deforming movement.

2. The tool set of claim 1, wherein said stop member is defined by a shoulder surrounding a truncated cone portion of said male die.

3. The tool set of claim 1 for connecting a first sheet of a predetermined thickness adjacent said male die to at least a second sheet adjacent said female die, said male die penetration depth exceeding said predetermined thickness but being smaller than the combined thicknesses of all sheets to be connected.

4. The tool set of claim 2 for connecting a first sheet of a predetermined thickness adjacent said male die to at least a second sheet adjacent said female die, said male die penetration depth exceeding said predetermined thickness but being smaller than the combined thicknesses of all sheets to be connected.

5. The tool set of claim 1 wherein said male die has a cross sectional area which is smaller than that of said female die cavity.

6. The tool set of claim 1 wherein said anvil has supporting means for supporting said forming members during a first phase of deformation, and said supporting means being deactivated upon a later phase of the connecting process.

7. The tool set of claim 6 wherein said supporting means include skew surfaces permitting said forming members to yieldingly slide therealong during said later phase

8. The tool set of claim 1 wherein said female die includes spring means for restoring an initial position of said forming members once a connection is completed and the sheets removed from the female die.

9. The tool set of claim 6 wherein said female die includes spring means for restoring an initial position of said forming members once a connection is completed and the sheets removed from the female die.

* * * * *